US005383483A

United States Patent [19]

Shibano

[11] Patent Number: 5,383,483

[45] Date of Patent: Jan. 24, 1995

[54] ULTRASONIC CLEANING AND DEBURRING APPARATUS

[76] Inventor: Yoshihide Shibano, 1629-1-12, Oyama-cho, Machida-shi, Tokyo, Japan

[21] Appl. No.: 181,875

[22] Filed: Jan. 13, 1994

Related U.S. Application Data

[62] Division of Ser. No. 960,876, Oct. 14, 1992, abandoned.

[51] Int. Cl.[6] ..... B08B 3/02

[52] U.S. Cl. ..... 134/111; 134/198; 134/184; 96/6

[58] Field of Search ..... 134/111, 184, 61, 184, 134/198, 200; 55/158

[56] References Cited

U.S. PATENT DOCUMENTS

| | | | |
|---|---|---|---|
| 4,865,060 | 9/1989 | Shibano | 134/60 |
| 4,865,061 | 9/1989 | Fowler et al. | 134/184 X |
| 4,867,186 | 9/1989 | Otsuka | 134/184 X |
| 4,907,611 | 3/1990 | Shibano | 134/60 |
| 4,986,837 | 1/1991 | Shibata | 55/158 X |
| 5,186,192 | 2/1993 | Netsu et al. | 134/184 X |
| 5,186,389 | 2/1993 | Shibano | 239/102.2 |
| 5,193,560 | 3/1993 | Tanaka et al. | 134/184 X |

*Primary Examiner*—Philip R. Coe
*Attorney, Agent, or Firm*—Paul A. Guss

[57] ABSTRACT

A cleaning solution is supplied from a solution reservoir to a workpiece held in a cleaning station through a cleaning solution supply passage extending from the solution reservoir to the solution reservoir. When the cleaning solution is supplied to the workpiece, ultrasonic energy is radiated into the cleaning solution to cavitate the cleaning solution for cleaning and deburring the workpiece. A deaerating device for deaerating the cleaning solution to be supplied to the workpiece has a casing disposed in the cleaning solution supply passage for passing the cleaning solution therethrough, gas separating membranes disposed in the casing and having passages defined therein for passage of the cleaning solution therethrough, and an evacuating unit for evacuating the casing to deaerate the cleaning solution flowing through the passages by drawing a gas contained in the cleaning solution through walls of the gas separating membranes.

3 Claims, 4 Drawing Sheets

ULTRASONIC CLEANING AND DEBURRING APPARATUS

This is a division of application Ser. No. 07/960,876, filed Oct. 14, 1992, status abandoned.

BACKGROUND OF THE INVENTION

1. Field of the Invention

The present invention relates to an apparatus for ultrasonically cleaning and deburring a workpiece.

2. Description of the Prior Art

Known ultrasonic cleaning and deburring apparatus supply a workpiece with a cleaning fluid which is cavitated by the application of ultrasonic energy, for cleaning or deburring the workpiece with the cavitation in the cleaning fluid. Specifically, some ultrasonic cleaning and deburring apparatus apply ultrasonic energy to the cleaning fluid while ejecting the cleaning from a spray gun to the workpiece. Other ultrasonic cleaning and deburring apparatus apply ultrasonic energy to the cleaning fluid as it is supplied into a cleaning tank with the workpiece placed in the cleaning tank.

In the conventional ultrasonic cleaning and deburring apparatus, the workpiece can be cleaned and deburred more effectively as a smaller amount of gas is contained in the cleaning fluid used. Therefore, the workpiece is usually cleaned and deburred using a deaerated cleaning fluid.

To deaerate the cleaning solution, it has been customary to employ a deaerating device that comprises a boiling tank for heating and boiling a cleaning solution to produce a steam, which is then condensed, as disclosed in U.S. Pat. No. 4,907,611, for example. The process carried out by such a conventional deaerating device is time-consuming because many steps, i.e., the heating, boiling, and deaerating steps, are required to deaerate the cleaning solution. The conventional deaerating device also needs a large expenditure of energy, is not effective enough to deaerate the cleaning solution, and is relatively poor in efficiency. Furthermore, the conventional deaerating device is comparatively large in size and complex.

SUMMARY OF THE INVENTION

It is therefore an object of the present invention to provide an ultrasonic cleaning and deburring apparatus of a relatively simple structure for deaerating a cleaning solution efficiently within a short period of time.

Another object of the present invention is to provide an ultrasonic cleaning and deburring apparatus which can efficiently reuse a cleaning solution that has been used to clean and deburr a workpiece, and which can effectively clean and deburr a workpiece.

According to the present invention, there is provided an apparatus for ultrasonically cleaning and deburring a workpiece, comprising a cleaning station for holding a workpiece therein, the cleaning station having a solution reservoir for storing a cleaning solution, supply means for supplying the cleaning solution from the solution reservoir to the workpiece held in the cleaning station, the supply means comprising a cleaning solution supply passage extending from the solution reservoir to the solution reservoir for passage of the cleaning solution therethrough, ultrasonic radiating means for radiating ultrasonic energy into the cleaning solution to cavitate the cleaning solution when the cleaning solution is supplied to the workpiece, whereby the workpiece is cleaned and deburred by the cavitated cleaning solution, and daerating means for daerating the cleaning solution to be supplied to the workpiece, the deaerating means comprising a casing disposed in the cleaning solution supply passage for passing the cleaning solution through, gas separating membranes disposed in the casing and having passages defined therein for passage of the cleaning solution therethrough, and evacuating means for evacuating the casing to deaerate the cleaning solution flowing through the passages by drawing a gas contained in the cleaning solution through walls of the gas separating membranes.

While the cleaning solution is being supplied from the solution reservoir through the cleaning solution supply passage to the workpiece held in the cleaning station, the cleaning solution flows into the casing and passes through the gas separating membranes. At this time, the casing is evacuated by the evacuating means to draw a gas contained in the cleaning solution through walls of the gas separating membranes to deaerate the cleaning solution flowing through the gas separating membranes. Therefore, the cleaning solution is deaerated with a simple structure. The deaerated cleaning solution is supplied to the workpiece. When the ultrasonic energy is radiated into the cleaning solution by the ultrasonic radiating means, the cleaning solution is cavitated. The cavitated cleaning solution is effective in cleaning and deburring the workpiece.

The workpiece may be cleaned and deburred by ejecting the deaerated cleaning solution to the workpiece from a spray gun connected to the downstream end of the cleaning solution supply passage. The ultrasonic radiating means may be disposed in the spray gun for radiating the ultrasonic energy into the cleaning solution.

The workpiece can be effectively cleaned and deburred by the cavitation in the cleaning solution and also by the pressure under which the cleaning solution is ejected to the workpiece.

The cleaning solution ejected from the spray gun to the workpiece may be recovered by the solution reservoir, and the recovered cleaning solution may be supplied from the solution reservoir to the spray gun again through a filter and the deaerating means in the cleaning solution supply passage. Thus, the cleaning solution may be reused efficiently. The filter in the cleaning solution supply passage should preferably be disposed upstream of the deaerating means.

The ultrasonic radiating means may be disposed in the solution reservoir, and the cleaning solution in the solution reservoir may be circulated in the filter and the deaerating means in the cleaning solution supply passage. With this arrangement, the workpiece may be cleaned and deburred in the cleaning solution in the solution reservoir, and the cleaning solution used for cleaning and deburring the workpiece may repeatedly be used efficiently.

The solution reservoir should preferably comprise a cleaning tank for storing the cleaning solution to clean the workpiece therein, the ultrasonic radiating means being disposed in the cleaning tank, and a recovery tank for recovering an overflow of the cleaning solution from the cleaning tank when the workpiece is placed in the cleaning solution in the cleaning tank. The cleaning solution overflow can thus be circulated from the recovery tank to the cleaning tank. At the time the workpiece is cleaned and deburred, the cleaning solution is prevented from being disturbed in the cleaning tank, and the cleaning solution in the cleaning tank is efficiently cavitated by the ultrasonic radiating means.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
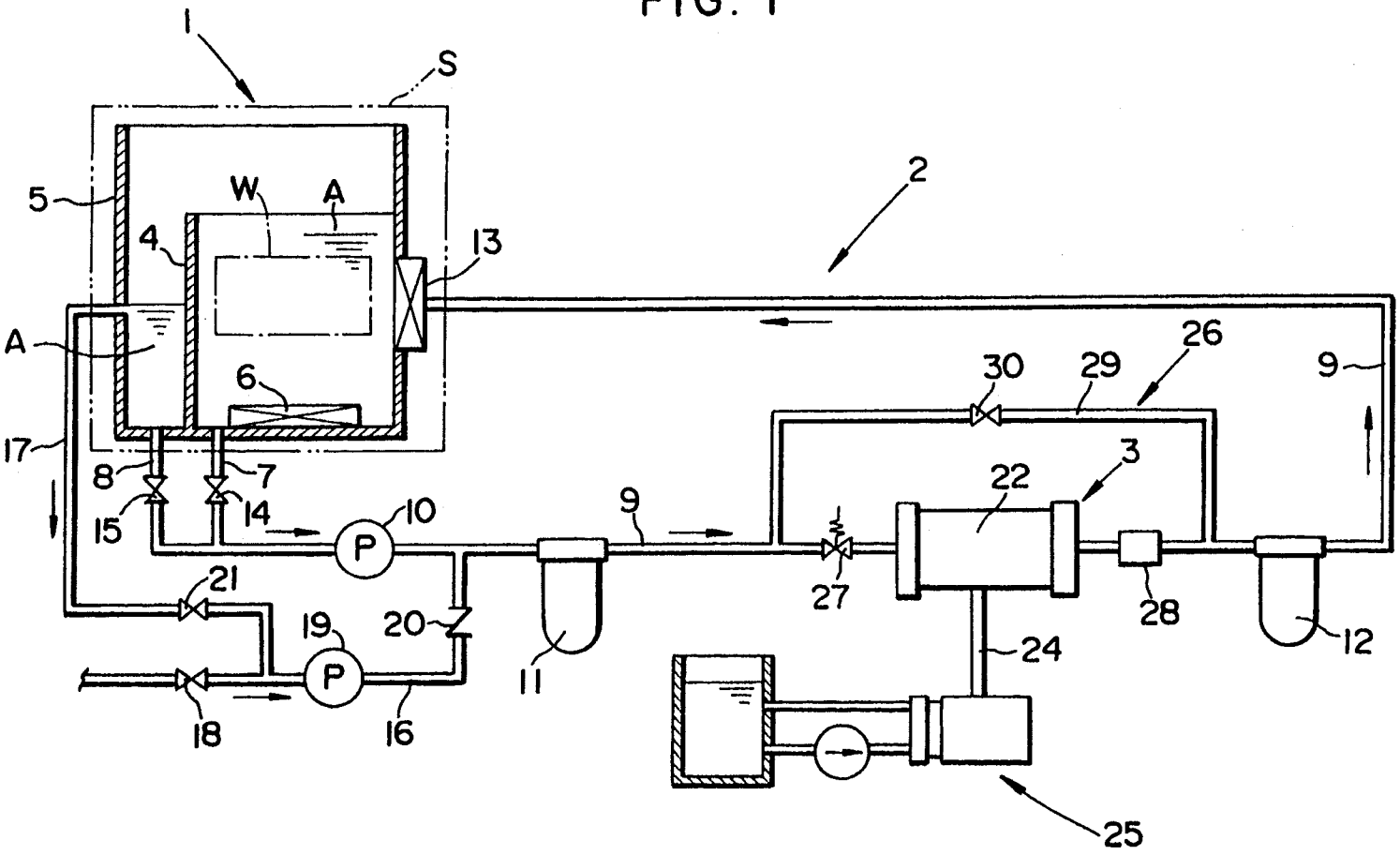
FIG. 1 is a systematic diagram of an ultrasonic cleaning and deburring apparatus according to a first embodiment of the present invention.

FIG. 1 shows an ultrasonic cleaning and deburring apparatus according to a first embodiment of the present invention. As shown in FIG. 1, the ultrasonic cleaning and deburring apparatus generally comprises a solution reservoir 1 disposed in a cleaning station S for cleaning and deburring a workpiece W, a cleaning solution supply device 2 for circulating and supplying a cleaning solution such as pure water or an organic solvent which is stored in the solution reservoir 1, and a deaerating device 3 for deaerating the cleaning solution A as it is supplied to the workpiece W.

The solution reservoir 1 is of a double-tank structure comprising a cleaning tank 4 substantially filled with the cleaning solution A and a recovery tank 5 housing the cleaning tank 4. The cleaning tank 4 and the recovery tank 5 are open upwardly. An ultrasonic oscillator 6 is disposed on the bottom of the cleaning tank 4. To clean and deburr the workpiece W, the workpiece W is lowered into and held in the cleaning solution A in the cleaning tank 4 by a robot or the like (not shown). Any overflow of the cleaning solution Q from the cleaning tank 4 at the time the workpiece W is charged into the cleaning tank 4 can be recovered from the recovery tank 5.

The cleaning solution supply device 2 comprises a cleaning solution supply passage 9 extending from the solution reservoir 1 through a pair of cleaning solution outlet passageways 7, 8 connected respectively to the bottoms of the cleaning and recovery tanks 4, 5. The cleaning solution supply device 2 also has a circulating pump 10, a filter 11, and a filter 12. The circulating pump 10, the filter 11, the deaerating device 3, and the filter 12 are successively disposed downstream, in the order named, in the cleaning solution supply passage 9. The cleaning solution supply passage 9 has a downstream end connected to a side wall of the cleaning tank 4.

When the circulating pump 10 operates, the cleaning solution supply device 2 introduces the cleaning solution from the solution reservoir 1 through the cleaning solution outlet passageways 7, 8 into the cleaning solution supply passage 9. The introduced cleaning solution A is filtered by the filters 11, 12, which remove foreign particles from the cleaning solution A. The cleaning solution A is also deaerated by the deaerating device 3. The deaerated cleaning solution A is returned through the cleaning solution supply passage 9 to the cleaning tank 4. In this manner, the cleaning solution A is circulated while being filtered and deaerated, and supplied to the workpiece W in the cleaning tank 4. The downstream end of the cleaning solution supply passage 9 is connected to the cleaning tank 4 through a flow rectifier 13, which prevents air bubbles from being formed in the deaerated cleaning solution A when it is supplied from the cleaning solution supply passage 9 into the cleaning solution 4.

The cleaning solution outlet passageways 7, 8 have respective adjustable valves 14, 15 for adjusting the rate at which the cleaning solution A circulates in the solution reservoir 1 and the cleaning solution supply passage 9.

The cleaning solution supply device 2 also includes a replenishing cleaning solution supply passage 16 connected to the cleaning solution supply passage 9 between the circulating pump 10 and the filter 11 for replenishing the cleaning solution supply passage 9 with a cleaning solution to compensate for a solution loss due to evaporation, splash, or the like, and an auxiliary cleaning solution outlet passageway 17 connected to a side wall of the recovery tank 5 for discharging the cleaning solution A from the recovery tank 5 in combination with the cleaning solution outlet passageway 8 in the event that a large amount of cleaning solution A overflows the cleaning tank 4.

The replenishing cleaning solution supply passage 16 has an upstream end connected to a replenishing solution reservoir (not shown), and also has an adjustable valve 18, a feed pump 19, and a check valve 20 that are successively arranged downstream, in the order named, in the replenishing cleaning solution supply passage 16.

When the feed pump 19 is actuated, the replenishing cleaning solution supply passage 16 replenishes the cleaning solution supply passage 9 with a cleaning solution from the replenishing solution reservoir. At this time, the rate at which the replenishing cleaning solution A flows can be adjusted by the valve 18. The check valve 20 prevents the cleaning solution A from flowing from the cleaning solution supply passage 9 back into the replenishing cleaning solution supply passage 16 owing to the pressure difference between the cleaning solution A flowing through the cleaning solution supply passage 9 and the cleaning solution A supplied from the replenishing cleaning solution supply passage 16 to the cleaning solution supply passage 9.

The auxiliary cleaning solution outlet passageway 17 has a downstream end joined to the replenishing cleaning solution supply passage 16 between the valve 18 and the feed pump 19. The auxiliary cleaning solution outlet passageway 17 delivers a large amount of cleaning solution overflow from the recovery tank 5 to the replenishing cleaning solution supply passage 16, and from replenishing cleaning solution supply passage 16 to the cleaning solution supply passage 9. The auxiliary cleaning solution outlet passageway 21 also has an adjustable valve 17 for adjusting the rate of flow of the cleaning solution overflow.

Figure 2:
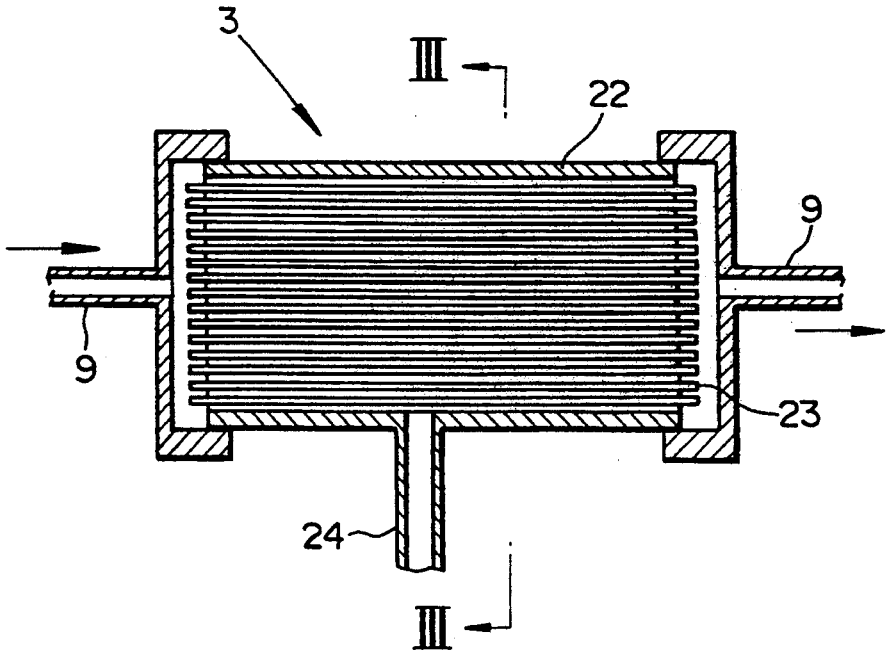
FIG. 2 is an enlarged cross-sectional view of a deaerating device of the ultrasonic cleaning and deburring apparatus shown in FIG. 1.
Figure 3:
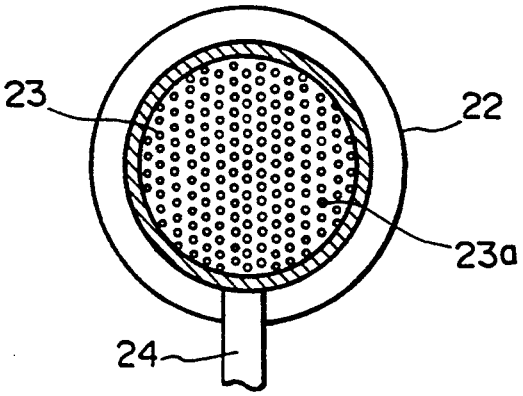
FIG. 3 is a cross-sectional view taken along line III—III of FIG. 2.

As shown in FIGS. 1 through 3, the deaerating device 3 comprises a casing 22 connected to the cleaning solution supply passage 9 for passing therethrough the cleaning solution A, a plurality of hollow fibrous gas separating membranes 23 disposed parallel to each other in the casing 22, and an evacuating unit 25 connected to the casing 22 through a suction passage 24 extending from a side wall of the casing 22. The evacuating unit 25 comprises a known water-sealed vacuum pump for evacuating the casing 22 through the suction passage 24. The gas separating membranes 23 have hollow inner spaces which define cleaning solution passages 23a, respectively, and have respective membrane walls capable of passing gases therethrough. The cleaning solution A flowing into the casing 22 from an upstream portion of the cleaning solution supply passage 9 flows through the cleaning solution passages 23a of the gas separating membranes 23, and then flows out of the casing 22 into a downstream portion of the cleaning solution supply passage 9.

While the cleaning solution A is flowing through the passages 23a of the gas separating membranes 23, the pressure in the casing 22 is reduced by the evacuating unit 25, drawing any gas contained in the cleaning solution A through the gas separating membranes 23. In this manner, the cleaning solution A is deaerated by the deaerating device 3.

In FIG. 1, the cleaning solution supply device 2 has an adjusting assembly 26 for adjusting the rate of flow of the cleaning solution A and the pressure thereof while the cleaning solution A is flowing through the casing 22.

The adjusting assembly 26 comprises a pressure regulating valve 27 disposed in the cleaning solution supply passage 9 upstream of the casing 22, a flow switch 28 disposed in the cleaning solution supply passage 9 downstream of the casing 22, a bypass passage 29 connected parallel to the cleaning solution supply passage 9 in bypassing relationship to the pressure regulating valve 27, the casing 22, and the flow switch 28, and an adjustable valve 30 disposed in the bypass passage 29. The rate at which the cleaning solution A flows through the casing 22 is detected by the flow switch 28. Depending on the detected rate, the pressure regulating valve 27 may be actuated to regulate the pressure of the cleaning solution A flowing in the casing 22 to a pressure level suitable for deaeration. Furthermore, the adjustable valve 30 may be actuated depending on the detected rate to adjust the rate at which the cleaning solution A flows from the cleaning solution supply passage 9 through the bypass supply passage 29, thereby adjusting the rate of flow of the cleaning solution A through the casing 22 to a level suitable for deaeration.

Operation of the ultrasonic cleaning and deburring apparatus will be described below.

To clean and deburr the workpiece W, the workpiece W is placed and held in the cleaning solution A filled in the cleaning tank 4, the circulating pump 10 is actuated, and the evacuating unit 25 is also actuated.

When the workpiece W is immersed in the cleaning solution A, a portion of the cleaning solution A overflows the cleaning tank 4 into the recovery tank 5, from which the cleaning solution A is delivered through the cleaning solution outlet passageway 8 into the cleaning solution supply passage 9.

Normally, the valve 14 disposed in the cleaning solution outlet passageway 7 joined to the cleaning tank 4 is substantially closed. Thus, the cleaning solution A is basically fed from the recovery tank 5 through the cleaning solution outlet passageway 8 into the cleaning solution supply passage 9.

The cleaning solution A delivered to the cleaning solution supply passage 9 is caused to flow therethrough by the circulating pump 10, and flows from the downstream end of the cleaning solution supply passage 9 through the flow rectifier 13 back to the cleaning tank 4. Therefore, the cleaning solution A in the cleaning tank 4 in which the workpiece W is immersed continuously circulates through the recovery tank 5, the cleaning solution supply passage 9, and the cleaning tank 4.

While the cleaning solution A is flowing through the cleaning solution supply passage 9, foreign particles such as dirt particles are filtered out by the filter 11. Then, the filtered cleaning solution A flows into the casing 22 of the deaerating device 3. The cleaning solution A introduced in the casing 22 is deaerated while it is flowing through the passages 23a of the gas separating membranes 23, as described above.

Since the cleaning solution A has substantially fully been filtered by the filter 11, the gas separating membranes 23 are prevented from being clogged by foreign material.

After being deaerated, the cleaning solution A flows again through the cleaning solution supply passage 9 into the filter 12. The filter 12 filters out foreign particles which have not been trapped by the upstream filter 11.

The cleaning solution A thus filtered by the filters 11, 12 and deaerated by the deaerating device 3 then flows through the flow rectifier 13 back into the cleaning tank 4, in which the circulating cleaning solution A is continuously supplied to the workpiece W.

If the solution reservoir 1 runs short of the cleaning solution A due to evaporation or the like while the cleaning solution A is circulating, then the cleaning solution supply passage 9 is replenished with the cleaning solution A from the solution reservoir (not shown) through the replenishing cleaning solution supply passage 16.

If the workpiece W is large causing a large cleaning solution overflow from the cleaning tank 4 into the recovery tank 5, then the cleaning solution overflow flows back to the cleaning solution supply passage 9 through the cleaning solution outlet passageway 8, and also flows back to the cleaning solution supply passage 9 through the auxiliary cleaning solution outlet passageway 17 and the replenishing cleaning solution supply passage 16.

When the cleaning solution A is deaerated by the deaerating device 3, the pressure and the flow rate of the cleaning solution A flowing into the casing 22 are adjusted to suitable levels by the adjusting assembly 26. Therefore, the cleaning solution A flowing into the casing 22 is efficiently and reliably deaerated while it passes through the passages 23a of the gas separating membranes 23.

Upon circulation of cleaning solution A while it is being filtered and deaerated, ultrasonic energy is radiated into the cleaning solution A in the cleaning tank 4 by the ultrasonic oscillator 6. The applied ultrasonic energy cavitates the cleaning solution A, and the workpiece W is cleaned and deburred by the cavitation in the cleaning solution A.

Inasmuch as the cleaning solution A in the cleaning tank 4 is deaerated at this time, the cavitation is smoothly developed in the cleaning solution A. The smoothly developed cavitation in the cleaning solution A, which is well filtered, is effective to clean and deburr the workpiece W efficiently.

In the first embodiment, the deaerated cleaning solution A is supplied back to the cleaning tank 4 through the flow rectifier 13 which prevents air bubbles from being formed in the cleaning solution A, and the cleaning solution A is not directly delivered to the cleaning solution supply passage 9, but circulates through the recovery tank 5. Accordingly, unwanted flow disturbances and air bubbles which would otherwise obstruct the development of cavitation in the cleaning tank 4 are reduced, resulting in an effective development of cavitation. Consequently, the workpiece W can be cleaned and deburred highly efficiently with the well developed cavitation in the cleaning solution A.

As described above, since the cleaning solution A is deaerated by the gas separating membranes 23, it can be deaerated with a relatively simple structure without a large expenditure of energy. The cleaning solution A that has been used to clean and the deburr the workpiece W can be efficiently reused, and is highly effective to clean and deburr the workplace W.

An ultrasonic cleaning and deburring apparatus according to a second embodiment of the present invention will be described below with reference to FIGS. 4 and 5.

Figure 4:
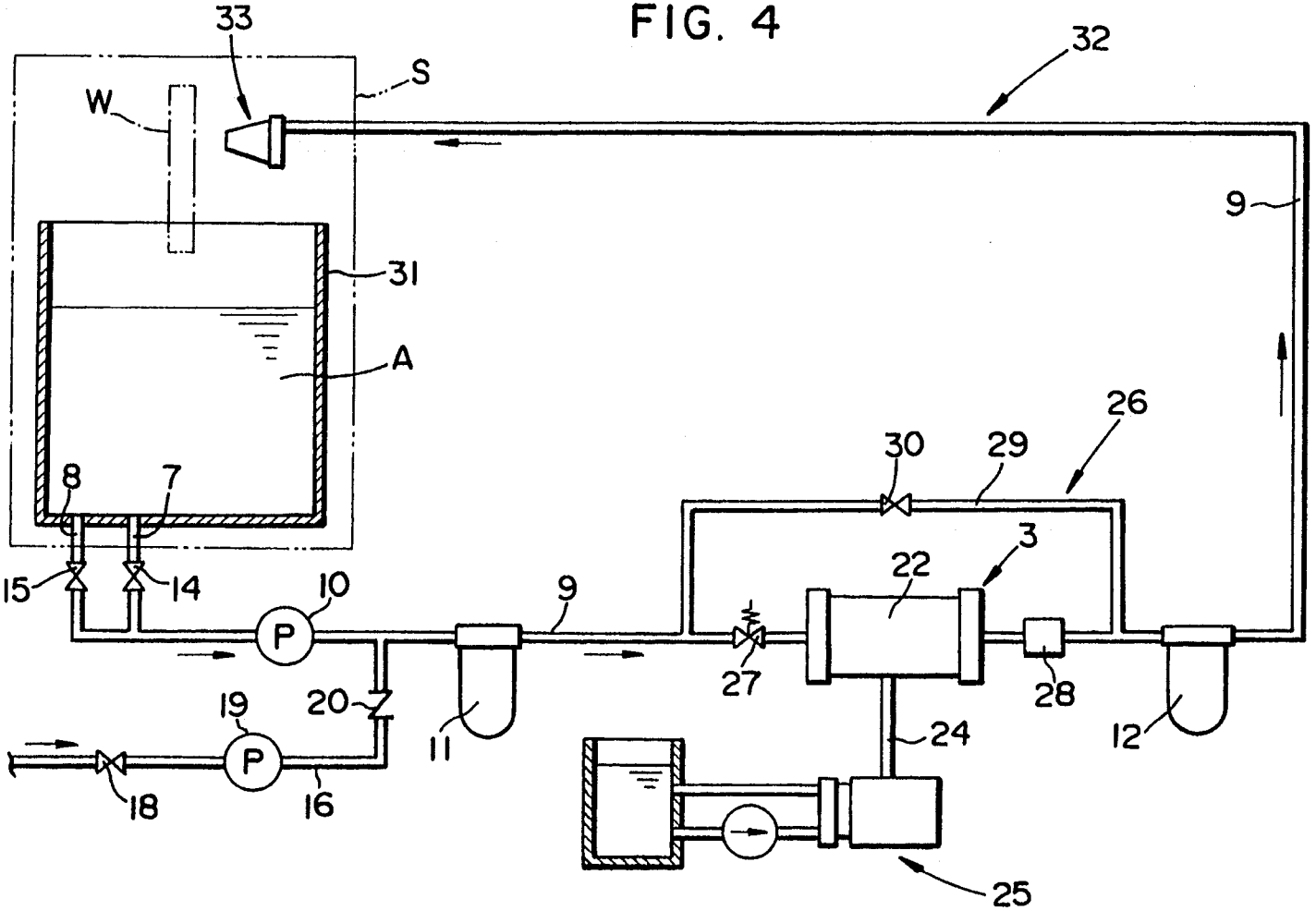
FIG. 4 is a systematic diagram of an ultrasonic cleaning and deburring apparatus according to a second embodiment of the present invention.
Figure 5:
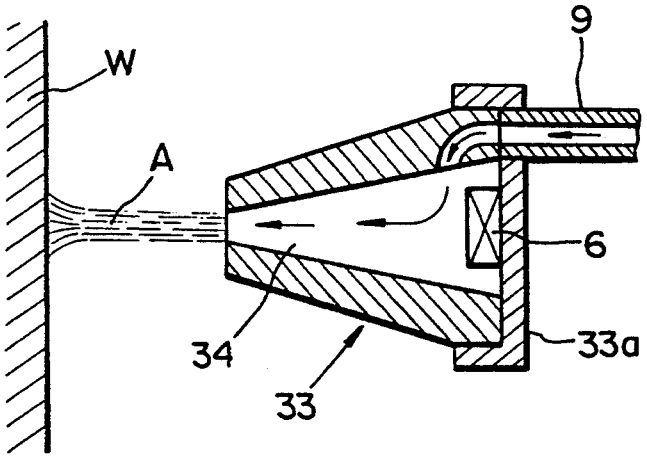
FIG. 5 is an enlarged cross-sectional view of a spray gun of the ultrasonic cleaning and deburring apparatus shown in FIG. 4.

Those parts shown in FIGS. 4 and 5 which are identical to those of the first embodiment are denoted by identical reference characters.

In FIG. 4, the ultrasonic cleaning and deburring apparatus generally comprises a one-tank solution reservoir 31 disposed in a cleaning station S for cleaning a workpiece W, and a cleaning solution supply assembly 32 for supplying a cleaning solution A stored in the solution reservoir 31 to the workpiece W that is held above the solution reservoir 31 by a workpiece holder (not shown).

The cleaning solution supply assembly 32 comprises a cleaning solution supply passage 9 extending from the bottom of the solution reservoir 31 through a pair of cleaning solution outlet passageways 7, 8, and a spray gun 33 attached to a downstream end of the cleaning solution supply passage 9. The spray gun 33 is positioned in laterally confronting relationship to the workpiece W above the solution reservoir 31 when the workpiece W is to be cleaned and deburred.

The cleaning solution supply passage 9 has a pump 10, filters 11, 12, a deaerating device 3, and an adjusting assembly 26 which are identical to those of the first embodiment shown in FIG. 1. A replenishing cleaning solution supply passage 16 which is identical to the corresponding passage in the first embodiment is connected to the cleaning solution supply passage 9 for replenishing the cleaning solution supply passage 9 with a cleaning solution.

As shown in FIG. 5, the spray gun 33 has a nozzle structure having a nozzle hole 34 defined therein, the nozzle hole 34 communicating with the cleaning solution supply passage 9 connected to a base plate 33*a* of the nozzle gun 33. When the nozzle hole 34 is supplied with the cleaning solution A from the cleaning solution supply passage 9, the spray gun 33 ejects the cleaning solution A through the nozzle hole 34 to the workpiece W. An ultrasonic oscillator 6 is fixedly mounted on the base plate 33*a* in facing relationship to the nozzle hole 34.

The ultrasonic cleaning and deburring apparatus according to the second embodiment operates as follows:

In FIG. 4, to clean and deburr the workpiece W, the workpiece W is held above the solution reservoir 31, and with the spray gun 33 confronting the workpiece W, the pump 10 of the cleaning solution supply passage 9 is actuated.

The cleaning solution A in the solution reservoir 31 is now supplied through the cleaning solution supply passage 9 to the spray gun 33. While the cleaning solution A is being supplied through the cleaning solution supply passage 9 to the spray gun 33, the cleaning solution A is filtered by the filters 11, 12 and deaerated by the deaerating device 3 in the same manner as described with reference to FIGS. 1 through 3.

The filtered and deaerated cleaning solution A which has been supplied to the spray gun 33 is ejected through the nozzle hole 34 to the workpiece W. At this time, ultrasonic energy is radiated into the cleaning solution A in the spray gun 33 by the ultrasonic oscillator 6, developing cavitation in the cleaning solution A as it is sprayed to the workpiece W.

When the cavitated cleaning solution A is ejected to the workpiece W, the workpiece W is cleaned and deburred by the pressure of the ejected cleaning solution A and the cavitation therein. Since the cleaning solution A ejected to the workpiece W has been deaerated by the daerating device 3, the cleaning solution A is deaerated highly efficiently. The cleaning solution A can effectively clean and deburr the workpiece W as foreign particles such as dirt particles have been removed from the cleaning solution W by the filters 11, 12. The pressure under which the cavitated cleaning solution A is applied to the workpiece W is also effective for cleaning and deburring the workpiece W.

The cleaning solution A applied to the workpiece W is recovered by the solution reservoir 31 positioned below the workpiece W, and then filtered and deaerated while passing through the cleaning solution supply passage 9, after which the cleaning solution A is ejected again to the workpiece W by the spray gun 33. Therefore, the cleaning solution A which has been used to clean and deburr the workpiece W is effectively reused.

In the ultrasonic cleaning and deburring apparatus according to the second embodiment, the cleaning solution A can be deaerated quickly and efficiently by the same deaerating device 3 as the deaerating device according to the first embodiment without consuming a large amount of energy. The workpiece W can be effectively and inexpensively cleaned and deburred because the cleaning solution A which has been used to clean and deburr the workpiece W is circulated for reuse.

Although certain preferred embodiments of the present invention have been shown and described in detail, it should be understood that various changes and modifications may be made therein without departing from the scope of the appended claims.

What is claimed is:

1. An apparatus for ultrasonically cleaning and deburring a workpiece, comprising:

a cleaning station for holding a workpiece therein, said cleaning station having a solution reservoir for storing a cleaning solution;

supply means for supplying the cleaning solution from said solution reservoir to the workpiece held in said cleaning station, said supply means comprising a cleaning solution supply passage extending from said solution reservoir for passage of the cleaning solution therethrough, said supply means further comprising a spray gun connected to a downstream end of said cleaning solution supply passage, said spray gun having a solution retaining chamber therein and a nozzle opening disposed at one end of said chamber, said nozzle opening being positioned in confronting relationship to said workpiece, wherein the cleaning solution is supplied into said chamber and thereafter ejected through said nozzle opening to the workpiece held in said cleaning station, wherein all of said cleaning solution stored in said solution reservoir is circulated through said supply passage and said spray gun to said workpiece and returned to said solution reservoir;

ultrasonic radiating means disposed in said solution retaining chamber of said spray gun for radiating ultrasonic energy into the cleaning solution to cavitate the cleaning solution in said chamber, whereby a cavitated cleaning solution is supplied to the workpiece through said nozzle opening and the workpiece is cleaned and deburred by the cavitated cleaning solution; and deaerating means for deaerating the cleaning solution to be supplied to the workpiece, said deaerating means comprising:

a casing disposed in said cleaning solution supply passage for passing the cleaning solution therethrough;

gas separating membranes disposed in said casing and having passages defined therein for passage of the cleaning solution therethrough; and evacuating means for evacuating said casing to deaerate the cleaning solution flowing through said passage by drawing a gas contained in said cleaning solution through walls of said gas separating membranes.

2. An apparatus according to claim 1, wherein said solution reservoir comprises means for recovering the cleaning solution ejected to the workpiece, said supply means having a filter disposed in said cleaning solution supply passage for filtering the cleaning solution flowing through said cleaning solution supply passage.

3. An apparatus according to claim 2, wherein said filter is positioned upstream of said casing.

* * * * *